US007922289B2

(12) United States Patent
Lee et al.

(10) Patent No.: US 7,922,289 B2
(45) Date of Patent: Apr. 12, 2011

(54) NOZZLE PLATE OF INKJET PRINTHEAD AND METHOD OF MANUFACTURING THE SAME

(75) Inventors: Jae-chang Lee, Hwaseong-si (KR); Tae-kyung Lee, Suwon-si (KR); Tae-woon Cha, Seoul (KR)

(73) Assignee: SAMSUNG Electronics Co., Ltd., Suwon-si (KR)

( * ) Notice: Subject to any disclaimer, the term of this patent is extended or adjusted under 35 U.S.C. 154(b) by 442 days.

(21) Appl. No.: 12/041,018

(22) Filed: Mar. 3, 2008

(65) Prior Publication Data

US 2009/0147049 A1 Jun. 11, 2009

(30) Foreign Application Priority Data

Dec. 11, 2007 (KR) ..... 10-2007-0128271

(51) Int. Cl.
*B41J 2/14* (2006.01)

(52) U.S. Cl. ..... 347/47; 347/71

(58) Field of Classification Search ..... 347/40, 347/43, 47, 71, 64, 65
See application file for complete search history.

(56) References Cited

U.S. PATENT DOCUMENTS 7,407,263 B2 * 8/2008 Kawase ..... 347/43

* cited by examiner

*Primary Examiner* — Lamson D Nguyen
(74) *Attorney, Agent, or Firm* — Stanzione & Kim, LLP

(57) ABSTRACT

Provided are a nozzle plate of an inkjet printhead and a method of manufacturing the same. The nozzle plate includes: a substrate including a plurality of nozzles; and a plurality of first grooves formed on the surface of a substrate around the nozzles. In this structure, ink remaining on the surface of the nozzle plate can be efficiently removed.

9 Claims, 13 Drawing Sheets

NOZZLE PLATE OF INKJET PRINTHEAD AND METHOD OF MANUFACTURING THE SAME

CROSS-REFERENCE TO RELATED APPLICATIONS

This application claims the benefit of Korean Patent Application No. 10-2007-0128271, filed on Dec. 11, 2007, in the Korean Intellectual Property Office, the disclosure of which is incorporated herein in its entirety by reference.

BACKGROUND OF THE INVENTION

1. Field of the Invention

The present invention relates to a nozzle plate of an inkjet printhead, and more particularly, to a nozzle plate including grooves formed around nozzles and a method of manufacturing the same.

2. Description of the Related Art

An inkjet printhead is an apparatus that ejects very small droplets of printing ink on a printing medium in a desired position to print an image in a predetermined color. Inkjet printheads may be largely classified into thermal inkjet printheads and piezoelectric inkjet printheads. The thermal inkjet printhead produces bubbles using a thermal source and ejects ink due to the expansive force of the bubbles. The piezoelectric inkjet printhead applies pressure generated by deforming a piezoelectric material to ink and ejects the ink due to the generated pressure.

In an inkjet printhead, when ink pressed by a pressure chamber is ejected via a nozzle of a nozzle plate, ink may be hardened and more viscous due to evaporation of a solvent in a nozzle outlet, and the sticking of dust or the mixture of bubbles may occur, thereby resulting in ejection failures. In order to solve the ejection failures, the surface of the nozzle plate of the inkjet printhead is wiped using a blade. Also, when the nozzle is clogged with ink or ejection failures occur after the inkjet printhead is used over a long period, a suction process or a purging process is performed on the printhead. In this case, ink may flow out from the nozzle and remain on the surface of the nozzle plate and thus, the ink remaining on the surface of the nozzle plate should be removed using a wiper. However, a wiping process, which is performed periodically by bringing the wiper into contact with the nozzle, damages a thin hydrophobic layer coated on the surface of the nozzle plate, thereby detrimentally affecting the ejection performance of the printhead. Also, contaminant factors, such as particles, which are present around the nozzle, may be stuck into the nozzle during the wiping process, thereby causing ejection failures.

SUMMARY OF THE INVENTION

The present invention provides a nozzle plate of an inkjet printhead and a method of manufacturing the same, which can prevent a wiper from directly contacting a nozzle plate and easily remove ink remaining on the surface of the nozzle plate. Specifically, a path is formed on the nozzle plate so that ink remaining on the surface of the nozzle plate can move via the path during a purging process or a suction process.

Also, the present invention provides a nozzle plate of an inkjet printhead and a method of manufacturing the same, which can prevent a hydrophobic layer coated on the surface of the nozzle plate from being damaged during a wiping process due to the clogging of a nozzle with particles or dust stuck to the nozzle plate or a wiper or a repeated wiping process.

According to an aspect of the present invention, there is provided a nozzle plate of an inkjet printhead. The nozzle plate of the inkjet printhead includes: a substrate including a plurality of nozzles; and a plurality of first grooves formed on the surface of a substrate around the nozzles.

The first groove may be formed to enclose the corresponding nozzle and extend from the nozzle on both sides of the substrate. Also, the nozzles may be arranged at regular intervals, and the first groove may be formed in a direction perpendicular to a direction in which the nozzles are arranged.

Second grooves may be connected to the first grooves, respectively, and formed along both end portions of the first grooves in a direction parallel to the direction in which the nozzles are arranged. Inner walls of the first and second grooves may be coated with a hydrophilic material, and an outer surface of the substrate may be coated with a hydrophobic material except the first and second grooves. Also, inner walls of the nozzles may be coated with a hydrophobic material. The first and second grooves may be formed using a wet etching process or a dry etching process.

The width of the first groove may increase or decrease towards both end portions of the first groove and away from the corresponding nozzle. Alternatively, the width of the first groove may be maintained constant from the corresponding nozzle to both end portions of the first groove.

The width of the first groove may decrease or be constant in a depthwise direction from the surface of the substrate.

According to another aspect of the present invention, there is provided a method of removing ink remaining on the surface of a nozzle plate of an inkjet printhead. The nozzle plate of the inkjet printhead includes: a substrate including a plurality of nozzles; a plurality of first grooves formed in the surface of a substrate around each of the nozzles; and second grooves may be formed in both end portions of the first grooves in a direction parallel to the nozzles and connected to the first grooves, respectively. The method includes: collecting ink remaining on the surface of the nozzle plate in the first groove formed around the nozzle; and draining ink from the first groove toward the second groove due to capillary attraction.

In order to facilitate the collection of ink remaining on the surface of the nozzle plate in the first groove formed around the nozzle, the method may further include wiping the surface of the nozzle plate using a wiper.

The method may further include applying a negative pressure to the nozzle plate or inclining the nozzle plate after collecting ink remaining on the surface of the nozzle plate in the first groove formed around the nozzle.

According to yet another aspect of the present invention, there is provided a method of manufacturing a nozzle plate. The method includes: preparing a substrate having a damper formed in a first surface of the substrate; forming a first oxide layer on the entire surface of the substrate; forming first photoresist on a second surface of the substrate and patterning the first photoresist by etching to form a groove pattern in the first oxide layer; removing the first photoresist, forming second photoresist on the second surface of the substrate, and patterning the second photoresist to form a nozzle pattern in the first oxide layer by etching; etching a portion of the substrate exposed by the nozzle pattern to a predetermined depth to form an upper portion of the nozzle; and removing the second photoresist and etching a portion of the substrate exposed by the groove pattern and a portion of the substrate exposed by the upper portion of the nozzle at the same time to form a groove with a predetermined depth and a nozzle connected to the damper.

After forming the groove and the nozzle, the method may further include: forming a second oxide layer on inner walls of the groove and the nozzle; laminating dry film resist (DFR) to cover the groove; coating a hydrophobic material on the surface of the substrate outside the nozzle; and inner walls of the nozzle and the damper and removing the DFR.

BRIEF DESCRIPTION OF THE DRAWINGS

The above and other features and advantages of the present invention will become more apparent by describing in detail exemplary embodiments thereof with reference to the attached drawings in which:

FIGS. 8A through 15A are plan views illustrating a method of manufacturing a nozzle plate according to an embodiment of the present invention; and FIGS. 8B through 15B are cross-sectional views corresponding to FIGS. 8A through 15A, respectively.

DETAILED DESCRIPTION OF THE PREFERRED EMBODIMENTS

Figure 1:
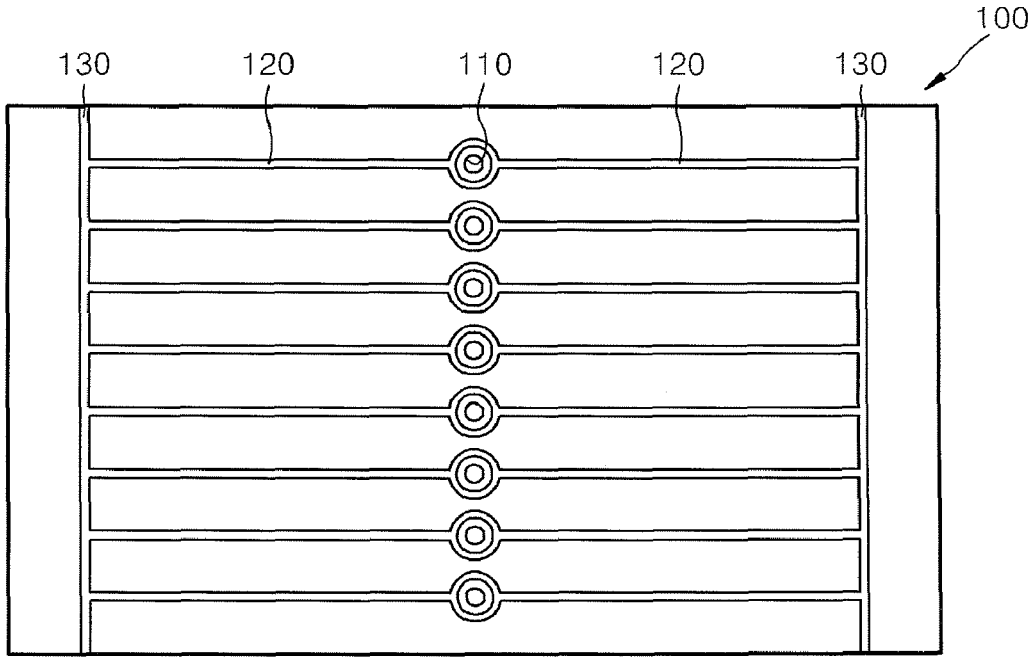
FIG. 1 is a plan view of a nozzle plate of an inkjet printhead according to an embodiment of the present invention.

The present invention will be described more fully hereinafter with reference to the accompanying drawings, in which exemplary embodiments of the invention are shown. The same reference numerals are used to denote the same elements throughout the specification. In the drawings, the thicknesses of components are exaggerated for clarity.

Figure 2A:
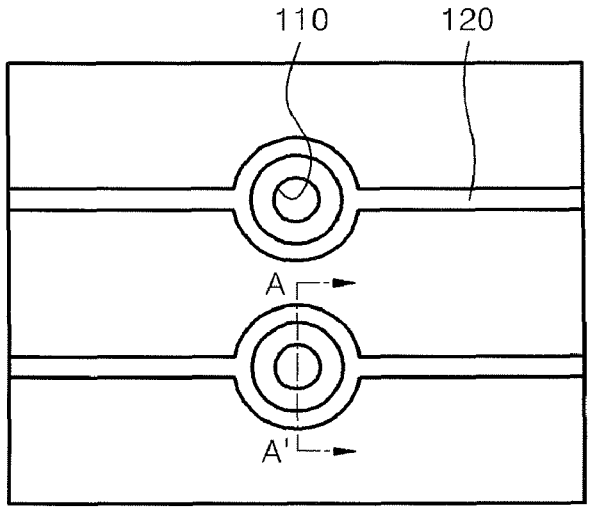
FIG. 2A is a magnified view of the nozzle shown in FIG. 1.
Figure 2B:
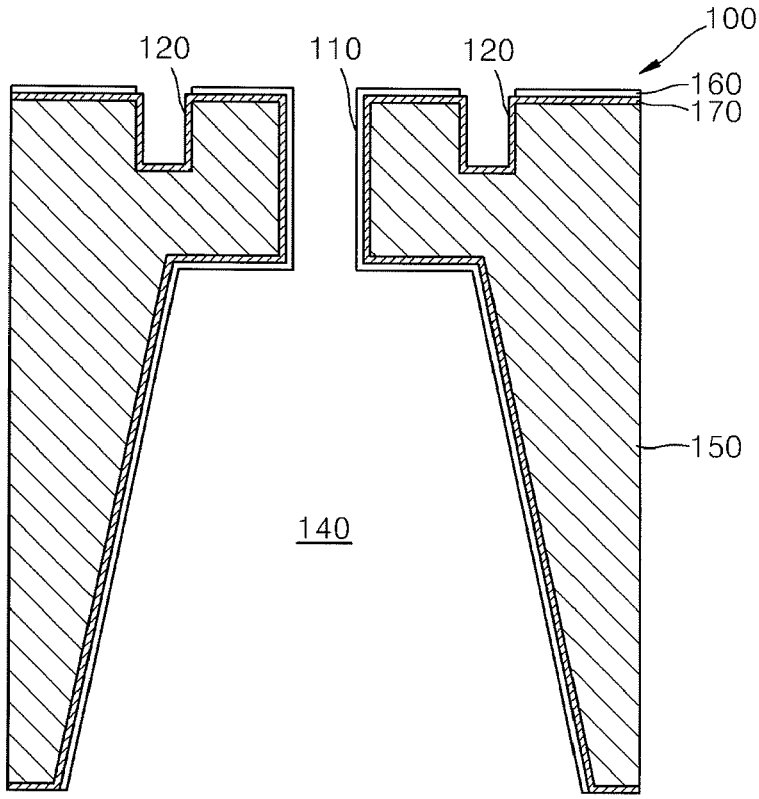
FIG. 2B is a cross-sectional view taken along a line A-A' of FIG. 2A.

FIG. 1 is a plan view of a nozzle plate 100 of an inkjet printhead according to an embodiment of the present invention, FIG. 2A is a magnified view of the nozzle shown in FIG. 1, and FIG. 2B is a cross-sectional view taken along a line A-A' of FIG. 2A.

Referring to FIGS. 1, 2A, and 2B, the nozzle plate 100 of the inkjet printhead includes a substrate 150, which has a plurality of nozzles 110 and a plurality of first grooves 120 formed around the nozzles 110. The substrate 150 may be, for example, a silicon substrate, but the present invention is not limited thereto. A plurality of nozzles 110 for ejecting ink may be formed at regular intervals in an upper portion of the substrate 150, and a plurality of dampers 140 are formed in a lower portion of the substrate 150 and connected to the nozzles 110, respectively. Each of the dampers 140 is an ink flow path that connects a pressure chamber (not shown) of the inkjet printhead with the corresponding nozzle 110.

The plurality of first grooves 120 are formed to a predetermined depth in the surface of the substrate 150 to correspond to the nozzles 110. As shown in FIG. 2A, the first groove 120 may be formed to enclose the corresponding nozzle 110 and extend on both sides of the substrate 150. Also, the width of the first groove 120 may be maintained constant from the nozzle 110 to both end portions of the first groove 120 as shown in FIG. 2A. Furthermore, the width of the first groove 120 may be maintained constant in a depthwise direction from the surface of the substrate 150 as shown in FIG. 2B. In this case, the first groove 120 may be formed by dry etching the substrate 150. Alternatively, the first groove 120 may be formed such that the width of the first groove 120 decreases in the depthwise direction from the surface of the substrate 150. In this case, the first groove 120 may be formed by wet etching the substrate 150. The first groove 120 functions to collect ink remaining on the surface of the nozzle plate 100. The first groove 120 may be formed in a direction perpendicular to a direction in which the nozzles 110 are arranged.

Second grooves 130 may be further formed along both end portions of the first grooves 120 and connected to the first grooves 120, respectively. Ink collected in the first grooves 120 can be drained toward the second grooves 130 due to capillary attraction. The second grooves 130 may be formed in a direction parallel to the direction in which the nozzles 110 are arranged.

A hydrophilic material layer, for example, an oxide layer 170, may be further coated on the entire surface of the substrate 150. For example, the oxide layer 170 may be a silicon oxide layer, but the present invention is not limited thereto. Also, a hydrophobic material layer 160 may be further coated on the entire surface of the oxide layer 170 except the first and second grooves 120 and 130. Thus, inner walls of the first and second grooves 120 and 130 may be coated with the hydrophilic material layer, for example, the oxide layer 170, and an outer surface of the substrate 150 and inner walls of the nozzle 110 and the damper 140 may be coated with a hydrophobic material layer except the first and second grooves 120 and 130.

Figure 3A:
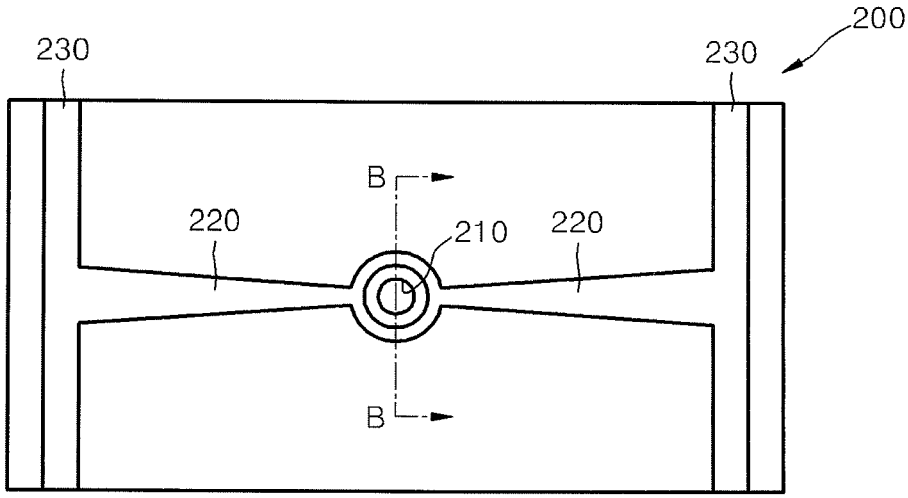
FIG. 3A is a plan view of a portion of a nozzle plate of an inkjet printhead according to another embodiment of the present invention.
Figure 3B:
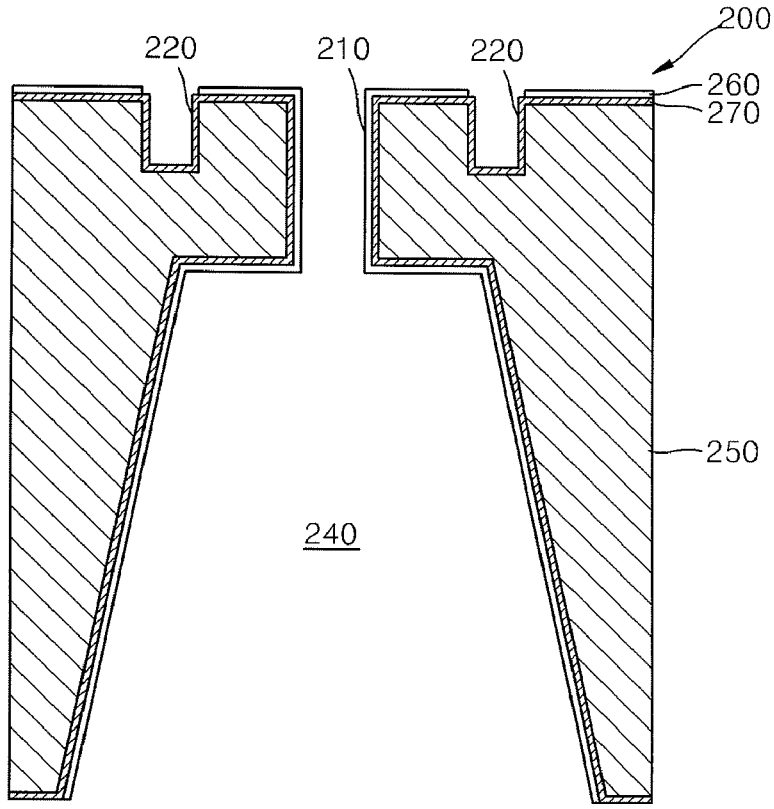
FIG. 3B is a cross-sectional view taken along a line B-B' of FIG. 3A.

FIG. 3A is a plan view of a portion of a nozzle plate 200 of an inkjet printhead according to another embodiment of the present invention, and FIG. 3B is a cross-sectional view taken along a line B-B' of FIG. 3A. Hereinafter, differences between the previous embodiment and the current embodiment will be principally explained.

Referring to FIGS. 3A and 3B, a plurality of nozzles 210 and a plurality of dampers 240 are formed in a substrate 250. A plurality of first grooves 220 are formed on the surface of the substrate 250 around the nozzles 210. Also, second grooves 230 are formed on both sides of the substrate 250 and connected to the first grooves 220, respectively. The first groove 220 may be formed such that the width of the first groove 220 increases towards both end portions of the first groove 220 and away from the corresponding nozzle 210. Also, the width of the first groove 220 may be maintained constant in a depthwise direction from the surface of the substrate 250 as shown in FIG. 3B. In this case, the first groove 220 may be formed by dry etching the substrate 250. Alternatively, the first groove 220 may be formed such that the width of the first groove 220 decreases in a depthwise direction from the surface of the substrate 250. In this case, the first groove 220 may be formed by wet etching the substrate 250. Also, inner walls of the first and second grooves 220 and 230 may be coated with a hydrophilic material layer, for example, an oxide layer 270, and an outer surface of the substrate 250 and inner walls of the nozzles 210 and the damper 240 may be coated with a hydrophobic material layer 260 except the first and second grooves 220 and 230.

Figure 4:
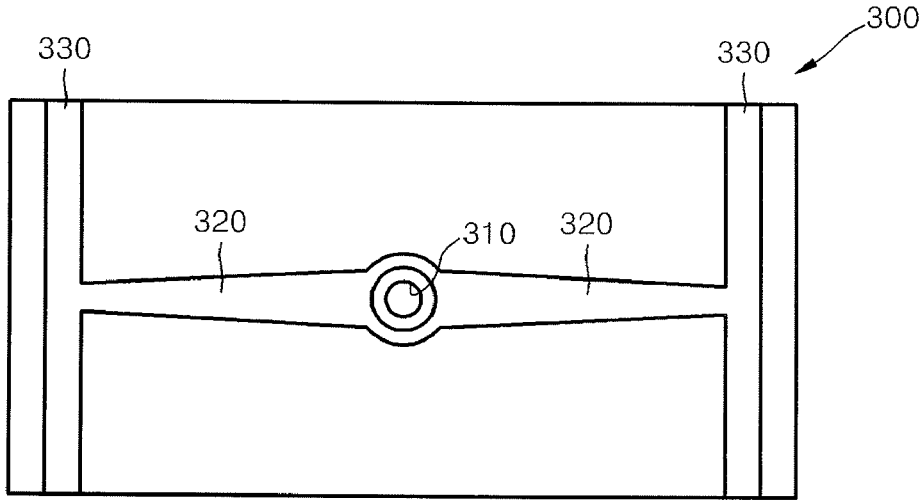
FIG. 4 is a plan view of a portion of a nozzle plate of an inkjet printhead according to another embodiment of the present invention.

FIG. 4 is a plan view of a portion of a nozzle plate 300 of an inkjet printhead according to another embodiment of the present invention.

Referring to FIG. 4, a first groove 320 is formed on the surface of a substrate (not shown) around a nozzle 310 such that the width of the first groove 320 decreases towards both end portions of the first groove 320 and away from the nozzle 310. Also, the first groove 320 is connected to second grooves 330. In this case, the first groove 320 may be formed such that the width of the first groove 320 is constant or decreases in a depthwise direction from the surface of the substrate.

Figure 5A:
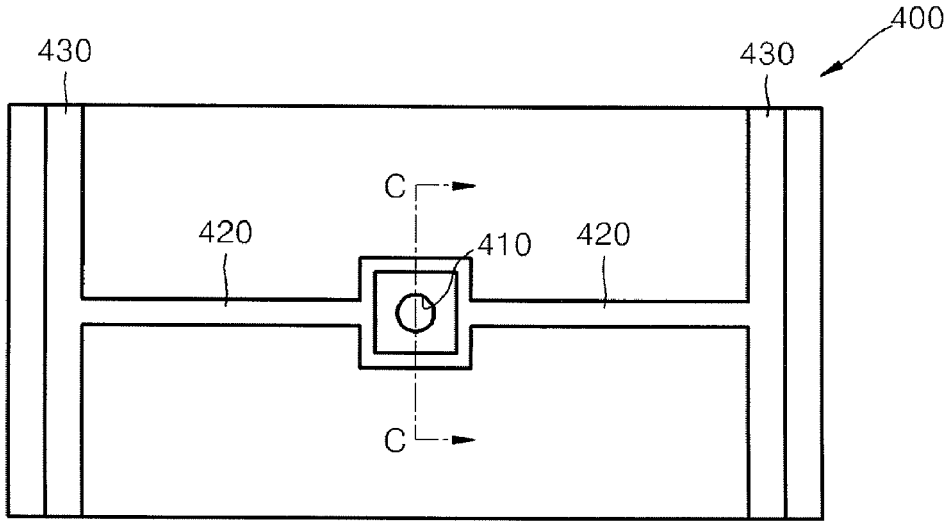
FIG. 5A is a plan view of a portion of a nozzle plate of an inkjet printhead according to another embodiment of the present invention.
Figure 5B:
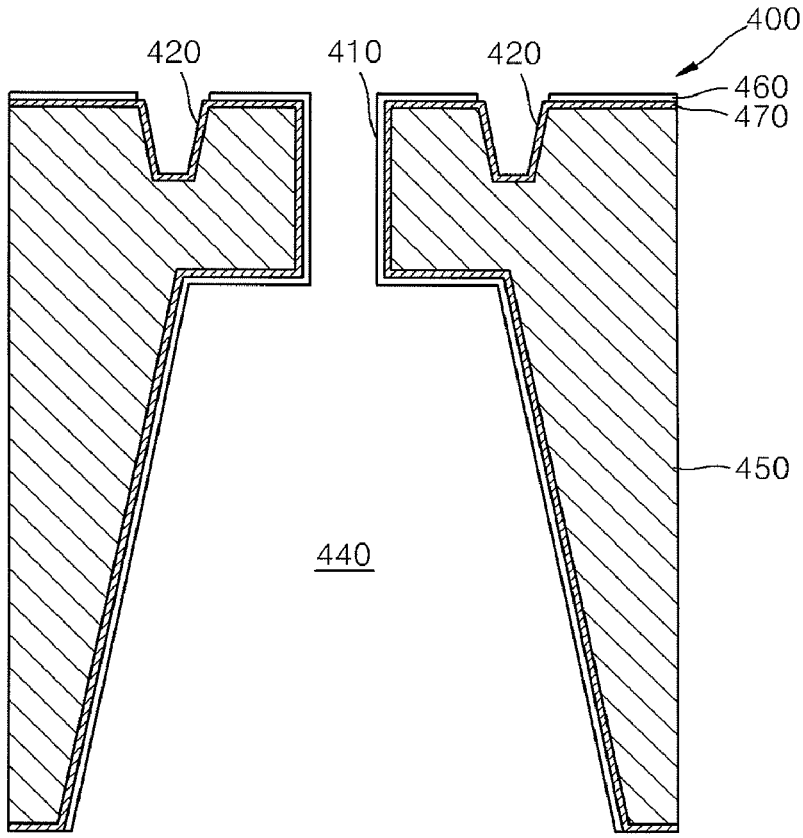
FIG. 5B is a cross-sectional view taken along a line C-C' of FIG. 5A.

FIG. 5A is a plan view of a portion of a nozzle plate 400 of an inkjet printhead according to another embodiment of the present invention, and FIG. 5B is a cross-sectional view taken along a line C-C' of FIG. 5A.

Referring to FIGS. 5A and 5B, a plurality of nozzles 410 and a plurality of dampers 440 are formed in a substrate 450, and a plurality of first grooves 420 are respectively formed on the surface of the substrate 450 around the nozzles 410. Also, second grooves 430 are formed on both sides of the substrate 450 and connected to the first grooves 420, respectively. As shown in FIG. 5A, the first groove 420 may have a square shape to enclose the corresponding nozzle 410 and may extend on both sides of the nozzle 410 on the surface of the substrate 450. In another embodiment, the first groove 420 may have one of various shapes other than the square shape to enclose the nozzle 410. As shown in FIG. 5A, the first groove 420 may be formed such that the width of the first groove 420 is maintained constant from the nozzle 510 to both end portions of the first groove 420. However, the first groove 420 may be formed such that the width of the first groove 420 decreases or increases towards both the end portions of the first groove 420 and away from the nozzle 410. Also, as shown in FIG. 5B, the first groove 420 may be formed such that the width of the first groove 420 gradually decreases in a depthwise direction from the surface of the substrate 450. In this case, the first groove 420 may be formed by wet etching the substrate 450. Alternatively, the first groove 430 may be formed such that the width of the first groove 420 is maintained constant in the depthwise direction from the surface of the substrate 450. In this case, the first groove 420 may be formed by dry etching the substrate 450. Also, inner walls of the first and second grooves 420 and 430 may be coated with a hydrophilic material layer, for example, an oxide layer 470, and an outer surface of the substrate 450 and inner walls of the nozzles 410 and the damper 440 may be coated with a hydrophobic material layer 460 except the first and second grooves 420 and 430.

In the above-described nozzle plates 100, 200, 300, and 400 of the inkjet printheads, ink remaining on the surfaces of the nozzle plates 100, 200, 300, and 400 is collected in the first grooves 120, 220, 320, and 420 around the nozzles 110, 210, 310, and 410 and drained toward the second grooves 130, 230, 330, and 430 due to capillary attraction.

Figure 6:
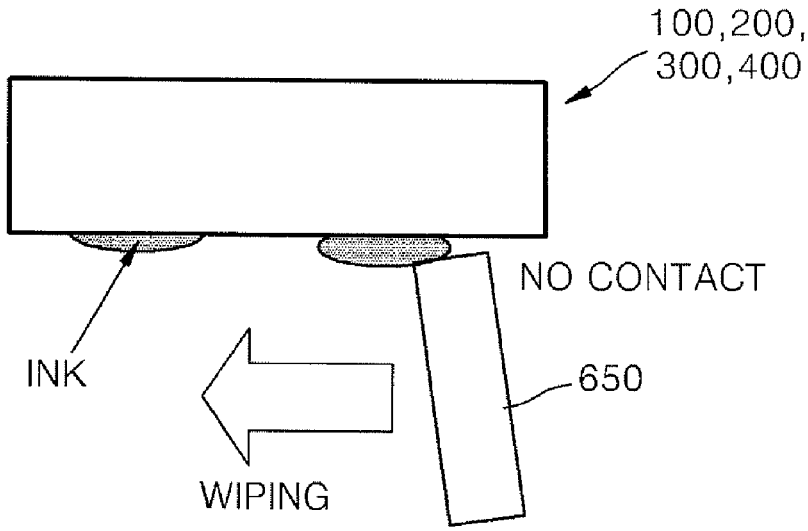
FIG. 6 is a diagram illustrating a method of removing ink remaining on the surface of a nozzle plate without bringing a wiper into contact with the nozzle plate according to an embodiment of the present invention.

FIG. 6 is a diagram illustrating a method of removing ink remaining on the surfaces of the nozzle plates 100, 200, 300, and 400 without bringing a wiper 650 into contact with the nozzle plates 100, 200, 300, and 400, according to an embodiment of the present invention.

When the surfaces of the nozzle plates 100, 200, 300, and 400 are wiped using the wiper 650 as shown in FIG. 6, ink remaining on the surfaces of the nozzle plates 100, 200, 300, and 400 can be collected more easily in the first grooves 120, 220, 320, and 420 around the nozzles 110, 210, 310, and 410.

Figure 7:
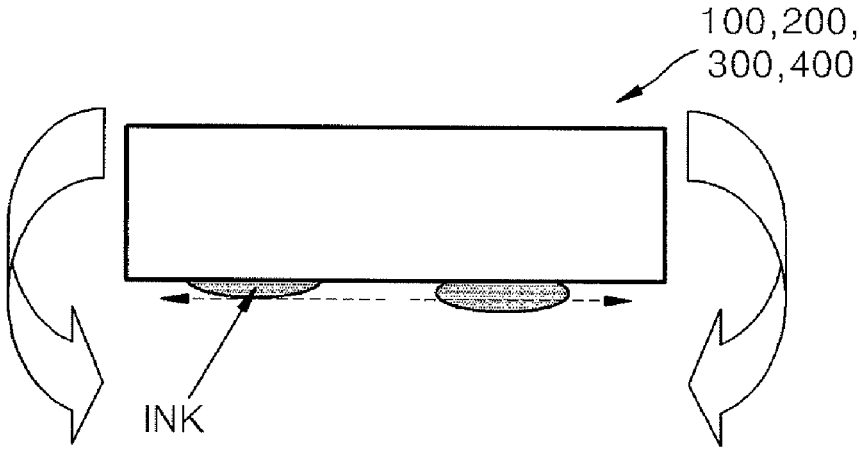
FIG. 7 is a diagram illustrating a method of removing ink remaining on the surface of a nozzle plate according to another embodiment of the present invention.

FIG. 7 is a diagram illustrating a method of removing ink remaining on the surfaces of the nozzle plates 100, 200, 300, and 400, according to another embodiment of the present invention.

Referring to FIG. 7, ink remaining on the surfaces of the nozzle plates 100, 200, 300, and 400 is collected in the first grooves 120, 220, 320, and 420 around the nozzles 110, 210, 310, and 410. Thereafter, a negative pressure may be applied to the nozzle plates 100, 200, 300, and 400 or the nozzle plates 100, 200, 300, and 400 may be inclined, thereby facilitating the removal of the remaining ink. When inclining the nozzle plates 100, 200, 300, and 400, ink remaining on the surfaces of the nozzle plates 100, 200, 300, and 400 can be collected in the first grooves 120, 220, 320, and 420 because the inner walls of the first grooves 120, 220, 320, and 420 and the second grooves 130, 230, 330, and 430 are coated with the hydrophilic material layers, for example, the oxide layers 170, 270, and 470 and the surfaces of the nozzle plates 100, 200, 300, and 400 are coated with the hydrophobic material layers 160, 260, and 460 except the first grooves 120, 220, 320, and 420 and the second grooves 130, 230, 330, and 430. Thus, ink remaining in hydrophobic regions of the nozzle plates 100, 200, 300, and 400 can be externally drained through the first grooves 120, 220, 320, and 420 and the second grooves 130, 230, 330, and 430, which are hydrophilic regions.

Hereinafter, a method of manufacturing a nozzle plate of an inkjet printhead according to an embodiment of the present invention will be described with reference to FIGS. 8A through 15B.

Figure 8A:
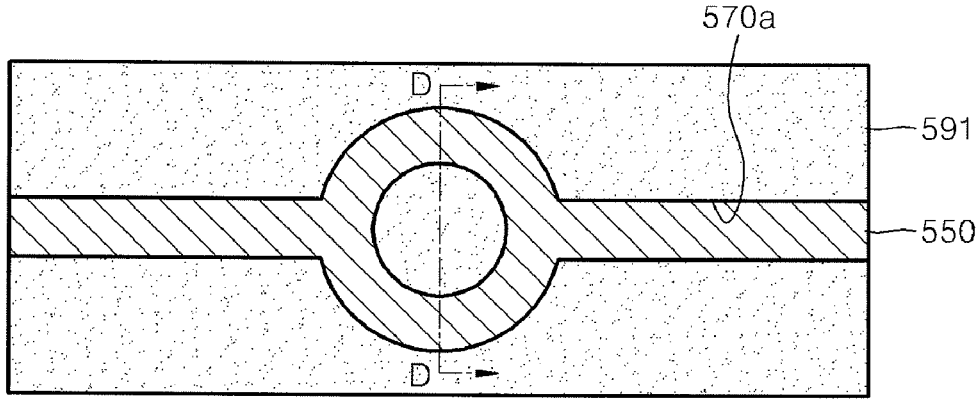
Figure 8B:
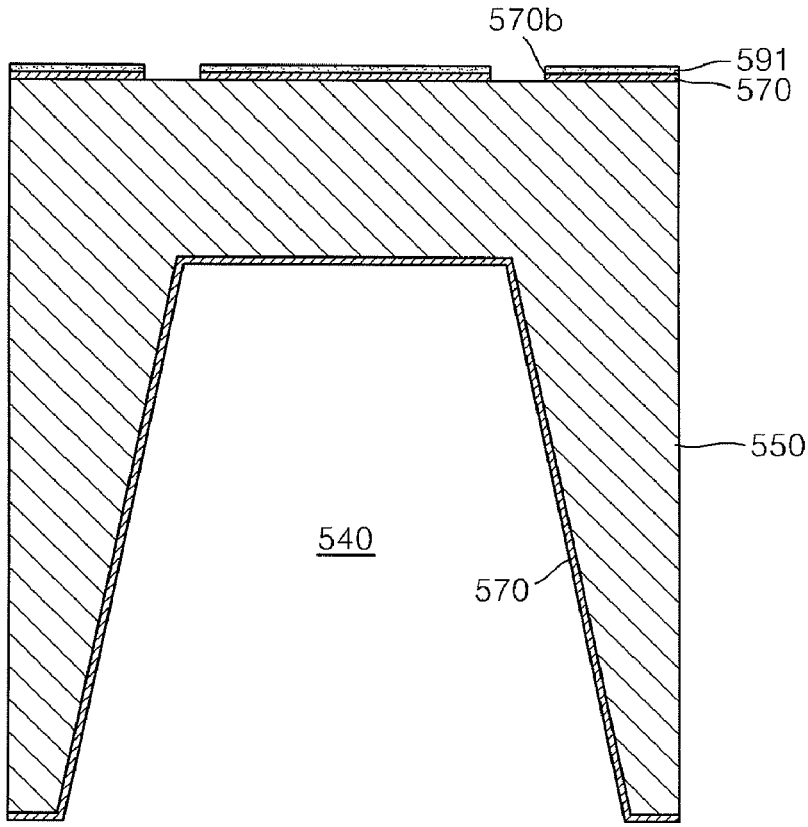

FIG. 8A is a plan view for explaining formation of a groove pattern 570*a* in an oxide layer 570 formed on a substrate 550, and FIG. 8B is a cross-sectional view taken along a line D-D' of FIG. 8A.

Referring to FIGS. 8A and 8B, initially, the substrate 550 under which a damper 540 is formed is prepared. The substrate 550 may be, for example, a silicon substrate, but the present invention is not limited thereto. Thereafter, the oxide layer 570 is formed on the entire surface of the substrate 550. The oxide layer 570 may be, for example, a silicon oxide layer. Thereafter, first photoresist 591 is coated on the oxide layer 570 formed on the top surface of the substrate 550. The first photoresist 591 is patterned using exposure and developing processes. When the oxide layer 570 is etched using the patterned first photoresist 591 as an etch mask, the groove pattern 570*a* having a predetermined shape is formed in the oxide layer 570 to expose the substrate 550.

Figure 9A:
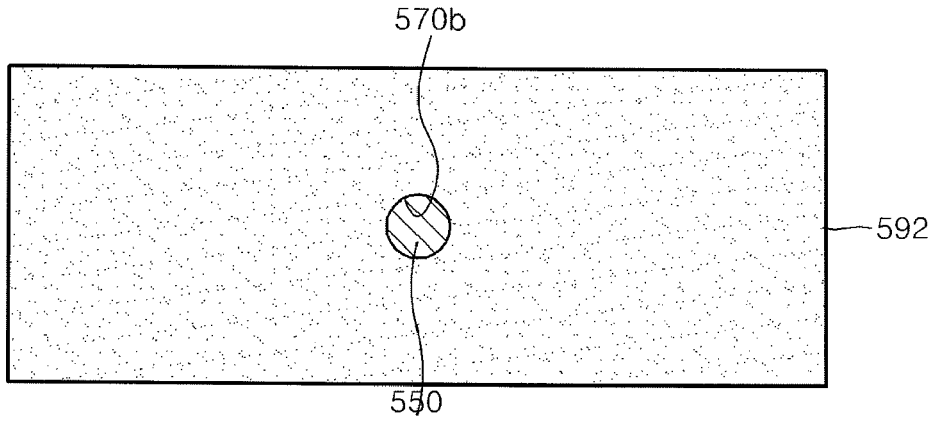
Figure 9B:
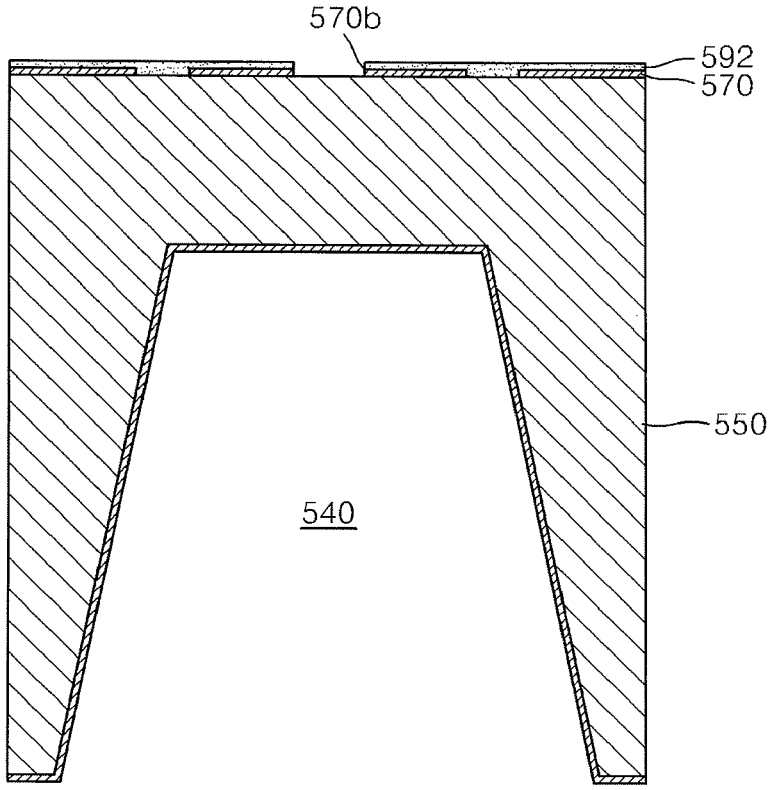

Referring to FIGS. 9A and 9B, the first photoresist 591 is removed, and second photoresist 592 is coated on the oxide layer 570 formed on the top surface of the substrate 550 and patterned. When the oxide layer 570 is etched using the patterned second photoresist 592 as an etch mask, a nozzle pattern 570*b* having a predetermined shape is formed in the oxide layer 570 to expose the substrate 550.

Figure 10A:
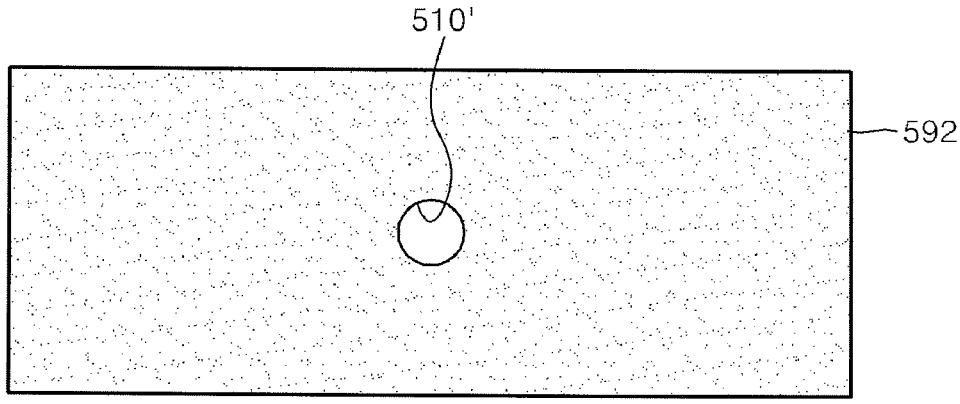
Figure 10B:
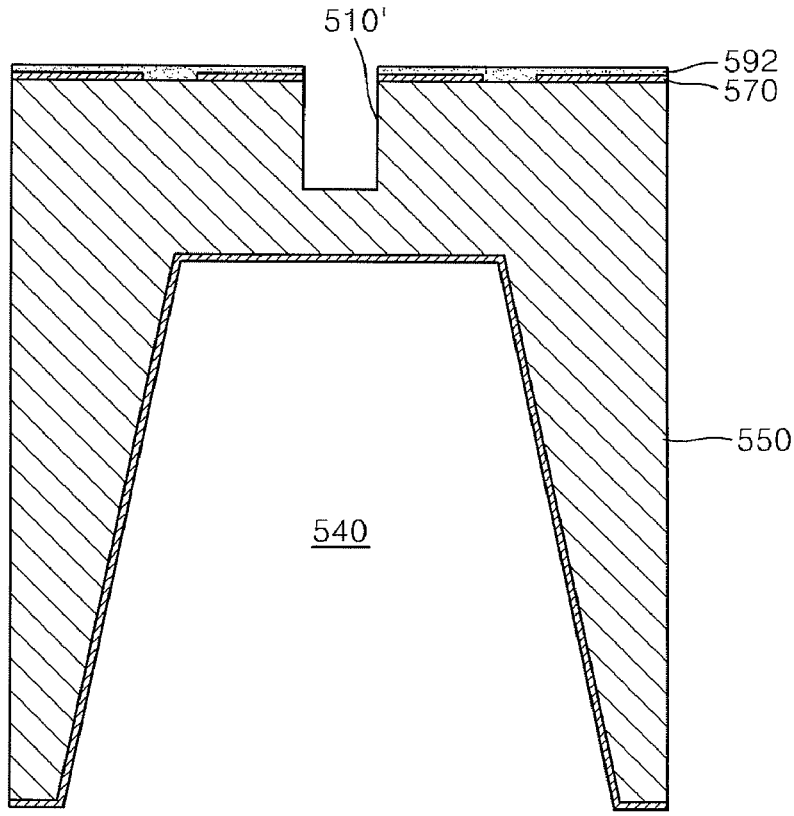

Referring to FIGS. 10A and 10B, a portion of the substrate 550 exposed by the nozzle pattern 570*b* is etched to a predetermined depth, thereby forming a nozzle upper portion 510'. As a result, a portion of the substrate 550 disposed between the nozzle upper portion 510' and the damper 540 has a thickness corresponding to the depth of a groove (refer to 520 in FIG. 11B) that will be formed in a subsequent process.

Figure 11A:
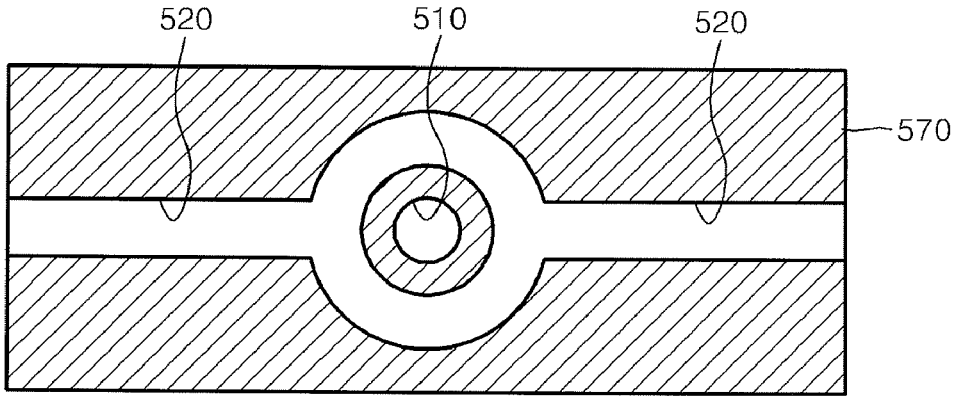
Figure 11B:
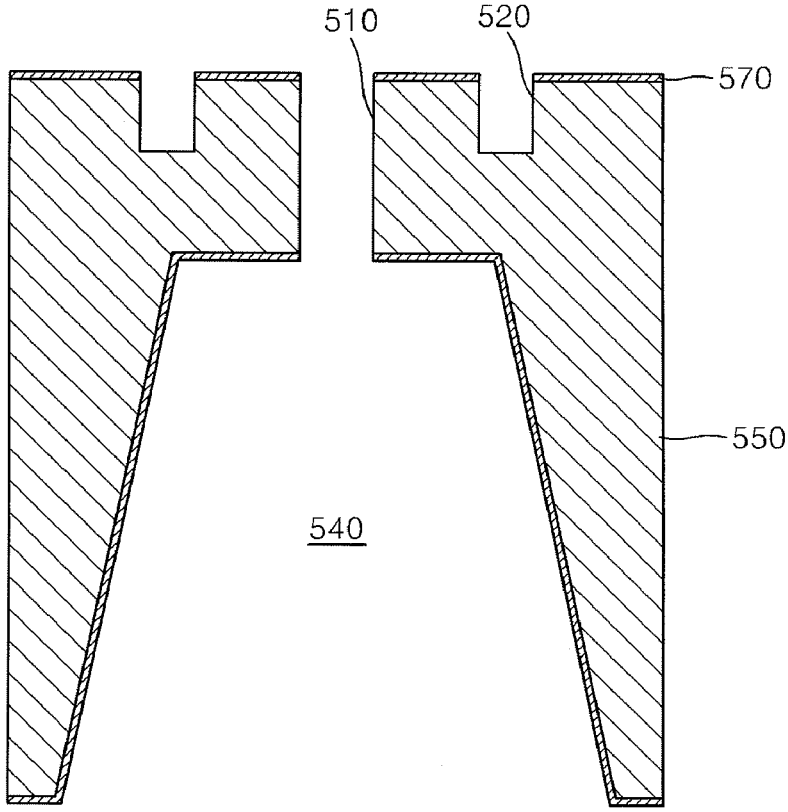

Referring to FIGS. 11A and 11B, the second photoresist 592 is removed, and a portion of the substrate 550 exposed by the groove pattern 570*a* and a portion of the substrate 550 exposed by the nozzle upper portion 510' are etched at the same time. As a result, a nozzle 510 is formed in an upper portion of the substrate 550 and connected to the damper 540, and a groove 520 having a predetermined depth is formed around the nozzle 510.

Meanwhile, the above-described method of manufacturing the nozzle plate according to the present invention may further include the following processes after forming the nozzle 510 and the groove 520.

Figure 12A:
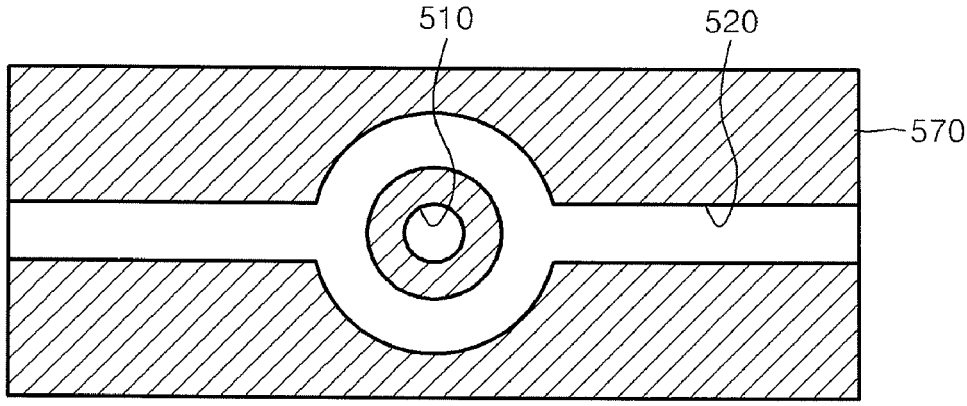
Figure 12B:
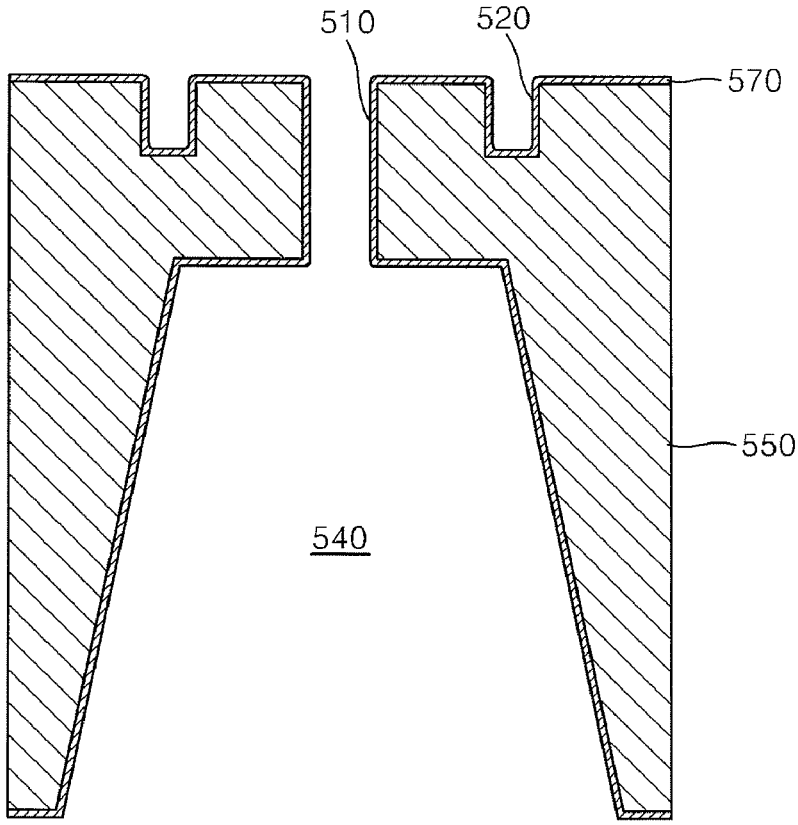

Referring to FIGS. 12A and 12B, an oxide layer 570 is formed on inner walls of the nozzle 510 and the groove 520. As described above, the oxide layer 570 may be a silicon oxide layer.

Figure 13A:
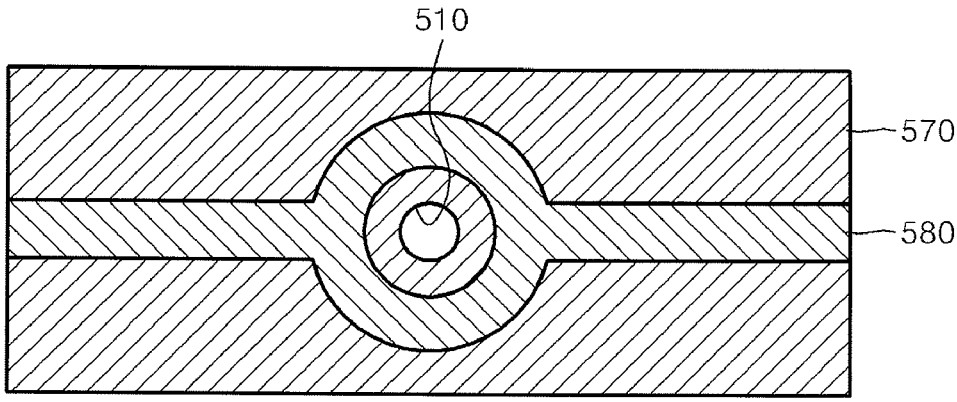
Figure 13B:
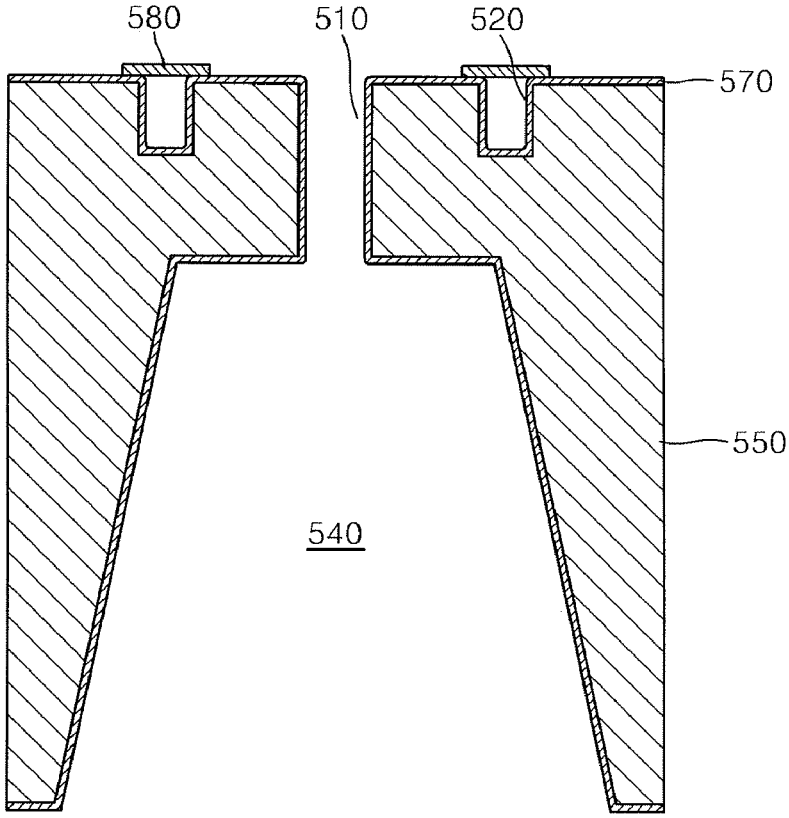

Referring to FIGS. 13A and 13B, a dry film resist (DFR) 580 is laminated on the enter surface of the substrate 550 having the nozzle 510 and the groove 520. Thereafter, the DFR 580 is patterned and left only on the groove 520. Thus, the patterned DFR 580 has a shape corresponding to the groove 520.

Figure 14A:
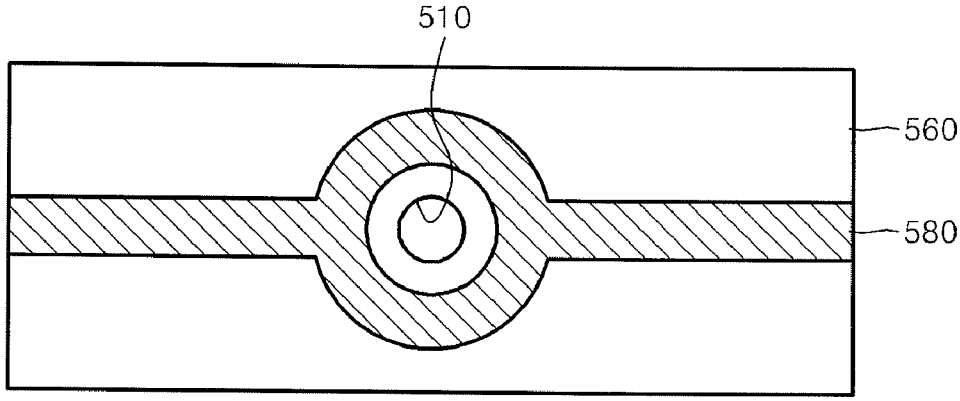
Figure 14B:
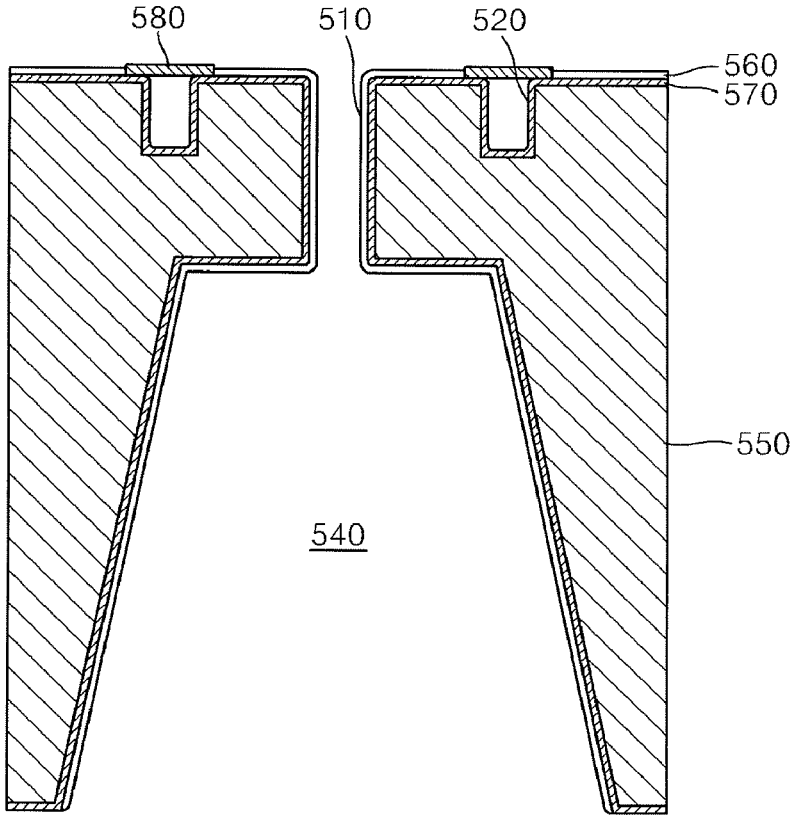

Referring to FIGS. 14A and 14B, a hydrophobic material layer 560 is coated on the entire surface of the oxide layer 570.

Figure 15A:
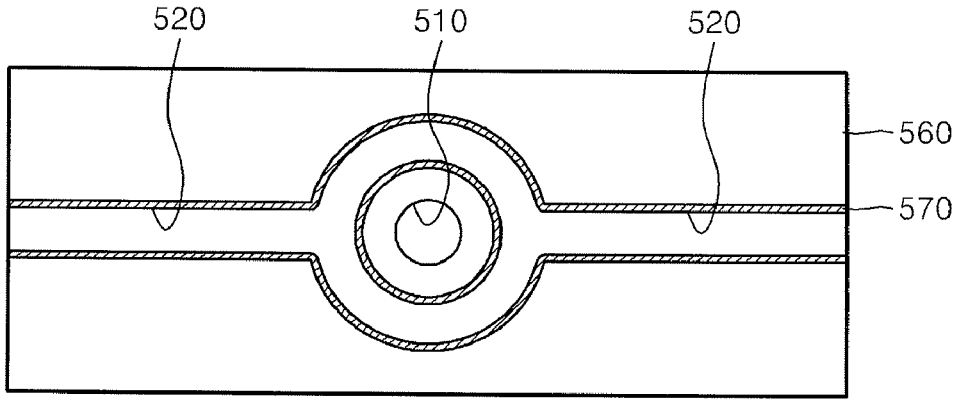
Figure 15B:
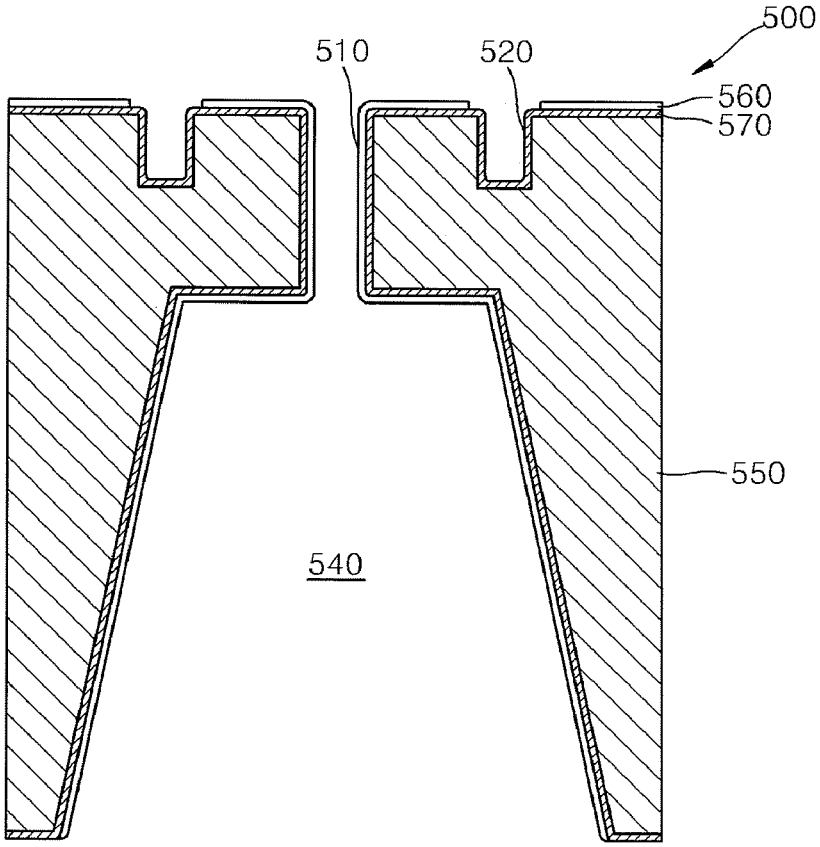

Referring to FIGS. 15A and 15B, the DFR 580 is removed from the groove 520, thereby completing the nozzle plate 500 according to the present invention. As a result, the oxide layer 570 is coated on the inner wall of the groove 520, and the hydrophobic material layer 560 is coated on an outer surface of the substrate 550 and inner walls of the nozzle 510 and the damper 540 except the groove 520.

While the present invention has been particularly shown and described with reference to exemplary embodiments thereof, it will be understood by one of ordinary skill in the art that various changes in form and details may be made therein without departing from the spirit and scope of the present invention as defined by the following claims.

What is claimed is:

1. A nozzle plate of an inkjet printhead, comprising:

a substrate including a plurality of nozzles; and a plurality of first grooves formed on a surface of the substrate around the nozzles, wherein second grooves are connected to the first grooves, respectively, and formed along both end portions of the first grooves in a direction parallel to the direction in which nozzles are arranged.

2. The nozzle plate of claim 1, wherein inner walls of the first and second grooves are coated with a hydrophilic material, and an outer surface of the substrate is coated with a hydrophobic material except the first and second grooves.

3. The nozzle plate of claim 1, wherein inner walls of the nozzles are coated with a hydrophobic material.

4. The nozzle plate of claim 1, wherein the first and second grooves are formed using a wet etching process or a dry etching process.

5. A method of removing ink remaining on the surface of the nozzle plate of the inkjet printhead according to claim 1, the method comprising:

collecting ink remaining on the surface of the nozzle plate in the first groove formed around the nozzle; and draining ink from the first groove toward the second groove due to capillary attraction.

6. The method of claim 5, further comprising wiping the surface of the nozzle plate using a wiper to facilitate the collecting of ink remaining on the surface of the nozzle plate in the first groove formed around the nozzle.

7. The method of claim 5, further comprising applying a negative pressure to the nozzle plate or inclining the nozzle plate after the collecting of ink remaining on the surface of the nozzle plate in the first groove formed around the nozzle.

8. A nozzle plate of an inkjet printhead, comprising:

a substrate including a plurality of nozzles; and a plurality of first grooves formed on a surface of the substrate around the nozzles, wherein a width of the first groove increases towards both end portions of the first groove and away from the corresponding nozzle.

9. A nozzle plate of an inkjet printhead, comprising:

a substrate including a plurality of nozzles; and a plurality of first grooves formed on a surface of the substrate around the nozzles, wherein the width of the first groove decreases towards both end portions of the first groove and away from the corresponding nozzle.

* * * * *